US006539567B1

(12) United States Patent
Bae

(10) Patent No.: US 6,539,567 B1
(45) Date of Patent: Apr. 1, 2003

(54) PILLOW WITH A BREATHABLE VALLEY

(76) Inventor: Stacey S. Bae, 11001 Jadestone Dr., Bakersfield, CA (US) 93311

( * ) Notice: Subject to any disclaimer, the term of this patent is extended or adjusted under 35 U.S.C. 154(b) by 0 days.

(21) Appl. No.: 10/005,498

(22) Filed: Dec. 7, 2001

(51) Int. Cl.[7] ..... A47C 20/02
(52) U.S. Cl. ..... 5/638; 5/655
(58) Field of Search ..... 5/632, 636, 630, 5/655, 724

(56) References Cited

U.S. PATENT DOCUMENTS

| | | | | | |
|---|---|---|---|---|---|
| 2,552,476 | A | * | 5/1951 | Barton | 5/653 |
| 3,124,812 | A | | 3/1964 | Milton et al. | 5/338 |
| 3,694,831 | A | | 10/1972 | Treace | 5/338 |
| 4,535,878 | A | | 8/1985 | Grahl | 190/1 |
| D316,353 | S | | 4/1991 | Dobson | D6/601 |
| 5,279,237 | A | * | 1/1994 | Alivizatos | 112/475.05 |
| 5,367,731 | A | * | 11/1994 | O'Sullivan | 5/645 |
| 5,388,296 | A | | 2/1995 | Mansour | 5/636 |
| 5,423,099 | A | | 6/1995 | Gulli | 5/638 |
| 5,426,798 | A | | 6/1995 | Guarino | 5/461 |
| 5,535,468 | A | | 7/1996 | Mallernee | 5/638 |
| 5,813,066 | A | * | 9/1998 | Gebhard et al. | 5/655 |
| 5,864,904 | A | | 2/1999 | Rudick | 5/640 |

* cited by examiner

*Primary Examiner*—Heather Shackelford
*Assistant Examiner*—Fredrick Conley
(74) *Attorney, Agent, or Firm*—John K. Park; Park & Sutton LLP

(57) ABSTRACT

A pillow with a breathable valley for an infant includes a pillow having a top surface, a bottom surface, and a center portion. The top surface has a smoothly transitioning concave surface forming a top valley. The top valley is positioned about the center portion of the top surface. The top valley has an upper perimeter with a first closed side and a first open side. A first top valley extension projects from the first open side. A breathable semi-porous membrane rests within the top valley and the first top valley extension.

17 Claims, 5 Drawing Sheets

PILLOW WITH A BREATHABLE VALLEY

BACKGROUND

The present invention relates to pillows with indentations for the head. More particularly the present invention pertains to pillows for infants with indentations for the face or head.

Pillows are available that have indentations for the head and face. Chiropractors often recommend indented pillows for patients that experience neck or back pains. Various designs are available in pillows and even mattresses that seek to improve sleeping comfort and safety. Infant pillows are available that have a round indentation with a breathable fabric located about the middle portion of the pillow.

The infant is often placed face-up on the pillow, with the head cradled in a round valley. The infant can turn over to a prone, face-down position on the pillow. Usually, the infant's face will press against the membrane in the valley. Known designs have a thin fabric that allows the child to breathe through the fabric in the round valley. Occasionally the infant's body will slide downward on the pillow, which causes the infant's face to no longer be near enough to the valley to breath through the porous fabric of the valley. The child can be susceptible to suffocation when the only breathable fabric area is within the round valley. The child may roll over and in the process move their body sufficiently, such that the face does not rest on the porous fabric in the round valley. Instead, the infant's face presses against the pillow base, which is of greater density and is not a porous breathable fabric. Eventually, the child can suffocate if the face remains pressed against the pillow base.

The safety of newborn infants is a primary concern for parents. Many children die from crib death and suffocation. When their infant suddenly dies the anguish experienced by the parents is tremendous. The parents blame themselves for the infant's death or the parents feel helpless because they could not prevent the death.

The idea of a valley shaped pillow crevice is known as early as 1991. U.S. Design Pat. No. 316,353 by Dobson discloses an ornamental design for a pillow with an indented valley for cradling the head. The design patent does not disclose the idea of having a breathable portion within the valley.

U.S. Pat. No. 3,694,831 (1970) by Treace discloses the idea of a round breathable hole in the pillow for medical use. The body of the pillow is formed entirely of a flexible porous material that will conform to the contour of the patient's head. Additionally, the flexible porous material will permit the flow of air therethrough to reduce the perspiring of the patient and provide a free air passage. A breathable valley that extends from about the middle portion of the pillow to a side is not disclosed by the Treace Patent.

U.S. Pat. No. 5,426,798 by Guarino discloses a resting support, such as a mattress, having a breathable area about the middle portion of a valley. With conventional mattress, people desiring to sleep in a prone face down position are required to turn their heads in order to breathe. Prolonged fixation of the neck in this position creates muscular imbalances. Guarino's invention provides an opening through the mattress and also through the box spring to allow breathing for an adult. The invention relates predominantly to mattresses and a supplemental support for the forehead and does not illustrate a pillow.

The idea of an indented valley about the middle portion of a pillow with a breathable extension from the middle portion to a side, is not disclosed in the prior art.

Proper support of the head and neck by the pillow is important for another purpose. Plagiocephaly is a term used to describe the development of an abnormal shaped head, often resulting from external forces applied to the soft infant skull. Plagiocephaly literally means "oblique head" (from Greek: plagio=oblique and cephale=head). It is called a "parallelogram" deformity because if you look down on the infant's head from above, this is the shape you would normally see. From this view, it looks as if half of the head has been pushed forward, and it often accompanied by misalignment of the ears, and bulging of the forehead.

Many risk factors have been associated with the development of positional plagiocephaly, including back sleeping. Prior to 1992, the primary risk factors with plagiocephaly were considered to be a restrictive uterine environment and congenital muscular torticollis. However, following the publication of the American Academy of Pediatrics' (AAP) 1992 recommendation to sleep infants on their back to reduce the risk of SIDS (Sudden Infant Death Syndrome), the craniofacial centers around the country began to document a dramatic increase in the number of infants presenting plagiocephaly conditions. By 1996, several studies were published which documented the cause and affect relationship between back sleeping and the development of plagiocephaly. The American Academy of Pediatrics is now recommending the frequent rotation of the child's head to reduce the likelihood of American Academy of Pediatrics.

Using a pillow with a valley to provide support for the infant's head and a valley extension to support the infant's neck may decrease the likelihood of plagiocephaly. Only the back of the head supports the infant when they are laid directly on a mattress or floor. Providing a pillow with a concave indentation for the head provides additional surface area of support, upon which the sides of the head rest. An extension from the indentation for the head can also provide a cushioned pillow support surface for the neck. The neck has minimal contact with the underlying surface when the infant is placed face-up on a flat surface. A properly constructed and shaped pillow that increase the surface support area for the head and neck should significantly reduce the occurrence of plagiocephaly in infants.

Therefore there is a need for an infant pillow, which has a breathable area that includes a valley about the center portion of pillow, as well as a breathable area with a porous fabric that extends from about the center portion to a side of the pillow. The breathable area would allow the infant to breathe when the face and mouth are pressed against the porous fabric.

Additionally there is the need for the valley to support the infant's head and the valley extension to support the infant's neck to prevent plagiocephaly.

SUMMARY

An objective of the present idea is providing an infant pillow, which has a breathable area with a porous membrane that extends from about the center portion to the side of the pillow where the child's body rests. The advantage of the breathable area is continued breathing by the infant when the face and mouth are pressed against the porous fabric membrane.

Another objective of the infant pillow with a breathable valley is increasing the safety of newborn infants and reducing infant fatalities. Young infants are delicate, as their breathing systems are just beginning to develop. The infant usually does not have the motor skills to move their body once they roll over into a prone face down position. The child has a better chance of breathing with the inclusion of the valley extension with a porous membrane.

Another objective is eliminating the emotional trauma experienced by the parents when their infant dies. By using the infant pillow with a breathable valley parents can minimize the blame and regrets that they place upon themselves. The parents and relatives enhance the safety of their infant by providing a sleeping pillow that includes all viable safety features and characteristics. The Parent's confidence in the safety of their child can be significantly increased.

A further objective is reducing the likelihood that the infant will roll over on the pillow. An advantage of the infant pillow with a breathable valley is that the neck is cradled in a valley extension, so the infant is less likely to rollover. The head rests within the valley, while the neck is positioned within the valley extension. Since the neck is slightly lower than a typical pillow the infant body is less likely to rollover. The walls of the valley extension restrain the neck and body from rolling over when the neck is cradled within the valley extension.

A pillow with a breathable valley for an infant includes a pillow having a top surface, a bottom surface, and a center portion. The top surface has a smoothly transitioning concave surface forming a top valley. The top valley is positioned about the center portion of the top surface. The top valley has an upper perimeter with a first closed side and a first open side. A first top valley extension projects from the first open side. The top valley and the first top valley extension have an upper base. The top valley forms a substantially circular shape and the first top valley extension forms a substantially rectangular shape. The upper perimeter extends around the first top valley extension.

Similarly, the bottom surface has a smoothly transitioning concave surface forming a bottom valley about the center portion of the bottom surface. The bottom valley has a lower perimeter with a second closed side and a second open side. A bottom valley extension projects from the second open side. The bottom valley and the bottom valley extension have a lower base.

A semi-porous membrane is attached to the pillow. The membrane separates the upper base of the top valley and first top valley extension from the lower base of the bottom valley and bottom valley extension. The membrane is porous enough to allow the infant to breathe through the membrane when the face is in close proximity to the membrane.

A stiffener is attached to the pillow and the membrane. The stiffener holds the membrane taut so the infant's head can be supported and strengthens the connection between the pillow and the membrane. The pillow and the membrane are less likely to with the reinforcement of the stiffener.

The pillow has an outer covering, which encloses the pillow. A portion of the outer covering forms the membrane within the top valley and the first top valley extension. The outer covering has an exterior layer formed from a soft plush material that will not irritate the infant's skin. The exterior layer is a thin semi-porous material that allows the inhalation of air by the infant.

The interior layer is a foam-like material that is semi-porous and easily allows the passage of air. The interior layer is exposed within the upper base of the top valley and the first top valley extension. The foam-like interior layer is hidden internally within the pillow, except for the foam being exposed where the membrane is contained within the top valley and the first top valley extension. When the infant rolls over the face will press against the interior layer.

A design can be imprinted on the pillow that includes two eyes, a nose, the top valley as a mouth, the first top valley extension as a tongue, and whiskers extending from the cavity. Also, the outer edges of the pillow can be shaped to present the impression of a face.

A second first top valley extension can be added to the pillow with a breathable valley. The second first top valley extension can project from the upper perimeter of the top valley. The second first top valley extension can be positioned on the opposite side of the top valley from the initial first top valley extension. Typically, when the infant's body slides downward, toward the direction of their feet, the initial first top valley extension provides a breathable membrane for the infant's face. In addition, should the infant's body slide upward, away from their feet, the second first top valley extension can provide a breathable membrane for the face.

The first top valley extension has the semi-porous membrane, which the infant can breathe through. When the infant rolls over into a prone face down position the mouth and nose normally will remain in the top valley. In some cases the infant's body will slide downwards so that the face is slightly below the top valley. Without the first top valley extension the infant's face may be pressed against the portion of the pillow that does not have the semi-porous membrane. The infant can be susceptible to suffocation if the face remains pressed into the pillow where breathing is restricted. The first top valley extension provides an additional breathable area where the child is likely to press their nose and mouth. Safety for the infant is enhanced, while peace of mind for the parent is increased.

Although the present invention is briefly summarized, a fuller understanding of the invention can be obtained from the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
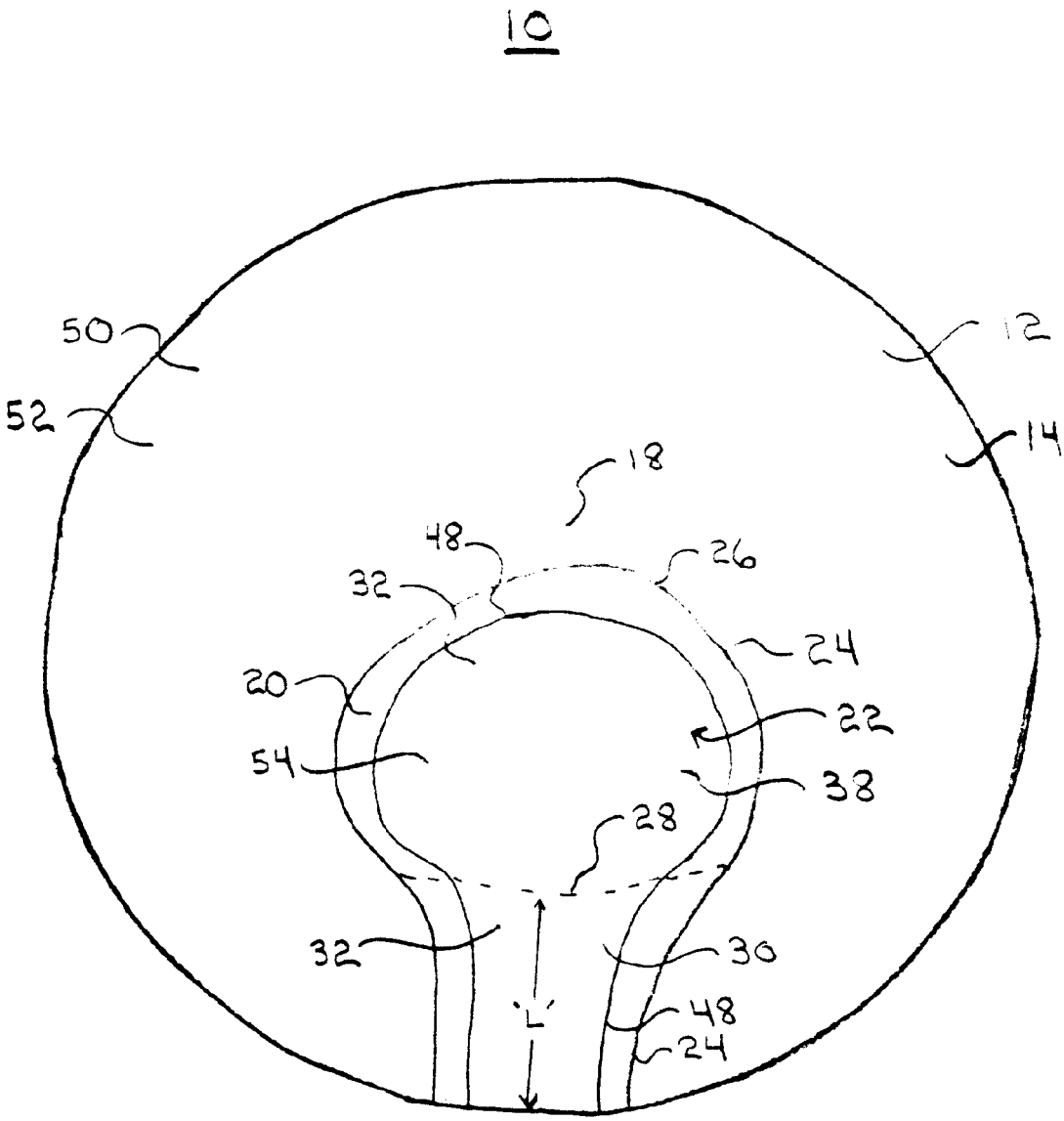
FIG. 1 is a top view.
Figure 2:
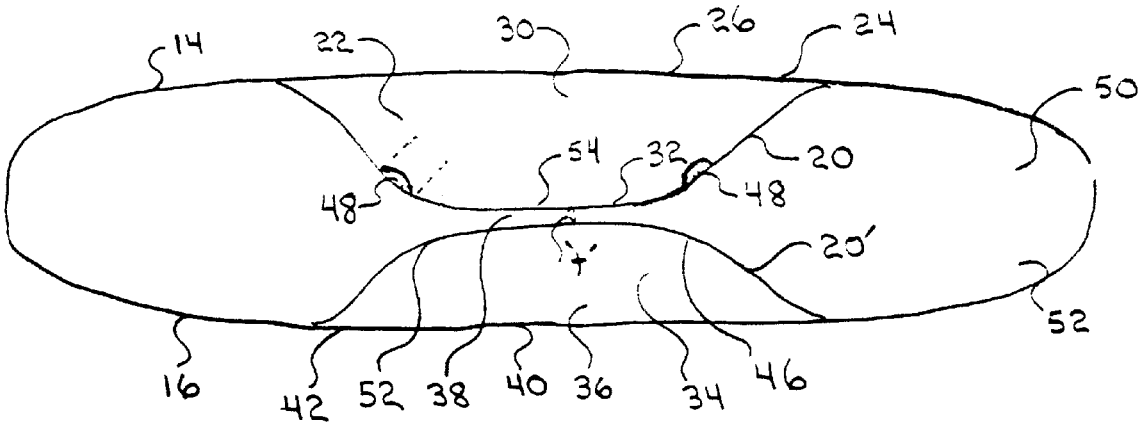
FIG. 2 is side view with a first top valley extension and first bottom valley extension.

Referring to FIGS. 1 and 2, an infant pillow with a breathable valley 10 for an infant includes a pillow 12 having a top surface 14, a bottom surface 16, and a center portion 18. The top surface 14 has a smoothly transitioning concave surface 20 forming a top valley 22. The top valley is positioned about the center portion 18 of the top surface 14. The top valley 22 has an upper perimeter 24 with a first closed side 26 and a first open side 28. A first top valley extension 30 projects from the first open side 28. The top valley 22 and the first top valley extension 30 have an upper base 32. The top valley 22 forms a substantially circular shape and the first top valley extension 30 forms a substantially rectangular shape. The upper perimeter 24 extends around the top valley 22 and the first top valley extension 30. Similarly, the bottom surface 16 has a smoothly transitioning concave surface 20' forming a bottom valley 34 about the center portion 18 of the bottom surface 16. A bottom valley extension 36 projects from the bottom valley 34.

A semi-porous membrane 38 is attached to the pillow 12. The membrane 38 separates the top valley 22 from the bottom valley 34 and separates the first top valley extension 30 from the bottom valley extension 36. The membrane 38 is thin having a thickness 't' that is between about one sixty-fourth (1/64) inch and about five-sixteenth (5/16) of an inch.

Figure 3:
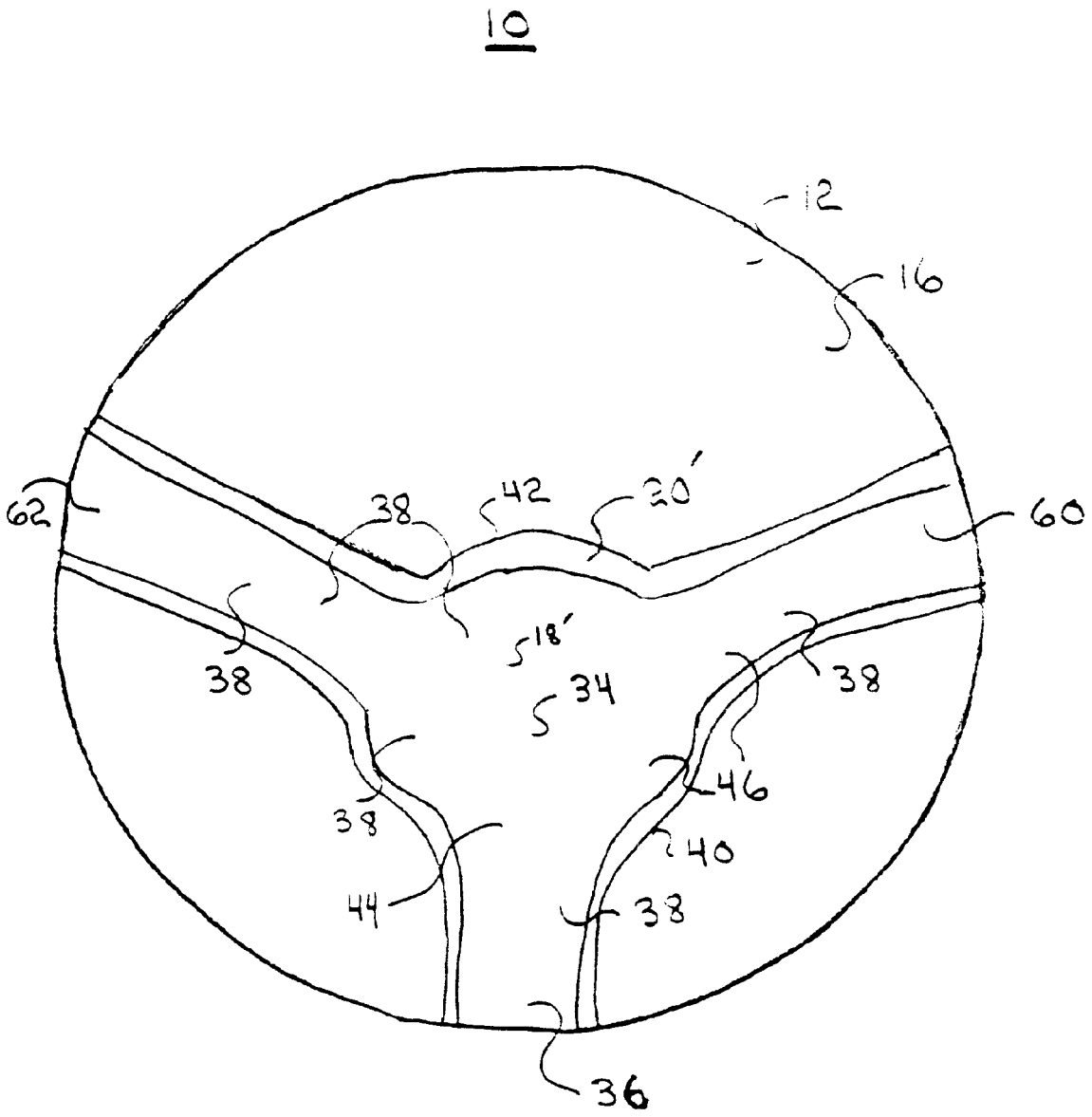
FIG. 3 is a bottom view of the pillow with a second bottom valley extension and a third bottom valley extension.

FIGS. 2 and 3 illustrate the bottom surface 16 with the smoothly transitioning concave surface 20' forming the bottom valley 34 about the center portion 18 of the bottom surface 16. The bottom valley 34 has a lower perimeter 40 with a second closed side 42 and a second open side 44. A bottom valley extension 36 projects from the second open side 44. The bottom valley 34 and the bottom valley extension 36 have a lower base 46. The membrane 38 separates the upper base 32 of the top valley 22 and first top valley extension 30 from the lower base 46 of the bottom valley 34 and bottom valley extension 36. As illustrated in FIG. 2, when the pillow 12 is lying top surface 14 facing up, then the bottom surface 16 is resting facing downward. When the pillow is in this position, the upper base 32 rests at the lower part of the top valley 22 and first top valley extension 30. While the lower base 46 rests at the higher portion of the bottom valley 34 and bottom valley extension 36.

A stiffener 48 is attached to the pillow 12 and the membrane 38. The stiffener 48 holds the membrane 38 taut so the infant's head can be supported. The stiffener 48 is formed from densely woven threads. Additionally, the stiffener 48 reinforces the attachment between the pillow 12 and the membrane 38 so they do not separate due to the weight of the infant resting upon the thin membrane 38. The stiffener 48 is a beading line with a height 'h'. The height 'h' is between about one-sixteenth (1/16) inch and about five-sixteenth (5/16) inch. The beading line is a narrow half-rounded molding.

Referring to FIGS. 1, 2 and 3, the pillow 12 has an outer covering 50, which encloses the pillow 12. A portion of the outer covering 50 forms the membrane 38 within the top valley 22 and the first top valley extension 30. The outer covering 50 has an exterior layer 52 and an interior layer 54. The exterior layer 52 is a soft plush cotton material that is gentle for the infant's skin. The exterior layer 52 is a thin semi-porous material, which allows the passage of air, so the infant can breathe through the outer covering 50.

The interior layer 54 is a foam-like material that is semi-porous and easily allows the passage of air. The interior layer 54 is exposed within the upper base 32 of the top valley 22 and the first top valley extension 30, so that the infant's head rests upon the interior layer 54. Should the infant rollover the face will rest upon the interior layer 54. This portion of the interior layer 54 and the exterior layer 52 combine to form the semi-porous membrane 38, which the infant can breathe through. The exterior layer 52 is exposed within the bottom valley 34 and the bottom valley extension 36. The exterior layer 52 covers substantially all of the pillow 12, except for the area of the upper base 32 of the top valley 22 and the first top valley extension 30 that exposes the membrane 38.

The combination of the top valley 22 and the first top valley extension 30 form an old-style key-hole shape. The top valley 22 is substantially circular with the substantially rectangular shaped first top valley extension 30 projecting downward. This overall shape is reminiscent of the image of an old-style key-hole. The first top valley extension 30 has a length 'L' that is between about 1 inch and about 4 inches. 'L' is about 2 inches. The figures are not shown to actual dimensions.

Figure 4:
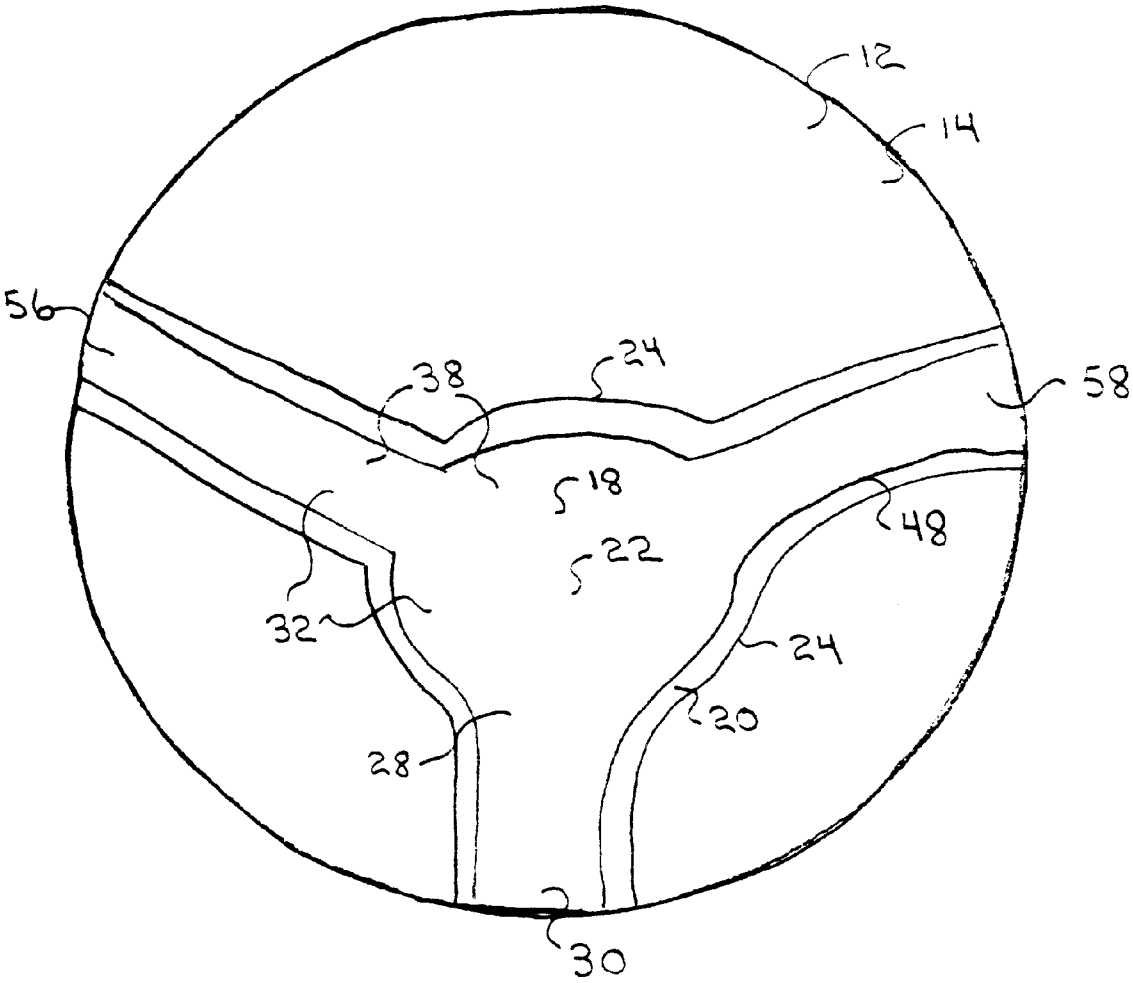
FIG. 4 is a top view of the pillow with a second top valley extension and a third top valley extension.

Referring to FIG. 3 and FIG. 4, a second top valley extension 56 and a third top valley extension 58 are added to the pillow 12. The second top valley extension 56 and the third top valley extension 58 extend radially from the top valley 22, beginning at about the upper perimeter 24. The first top valley extension 30 projects from the first open side 28.

Additionally, a second bottom valley extension 60 and a third bottom valley extension 62 are added to the pillow 12. The membrane 38 separates the upper base 24 of the second top valley extension 58 and the third top valley extension 60 from the lower base 46 of the second bottom valley extension 62 and third bottom valley extension 64.

Figure 5:
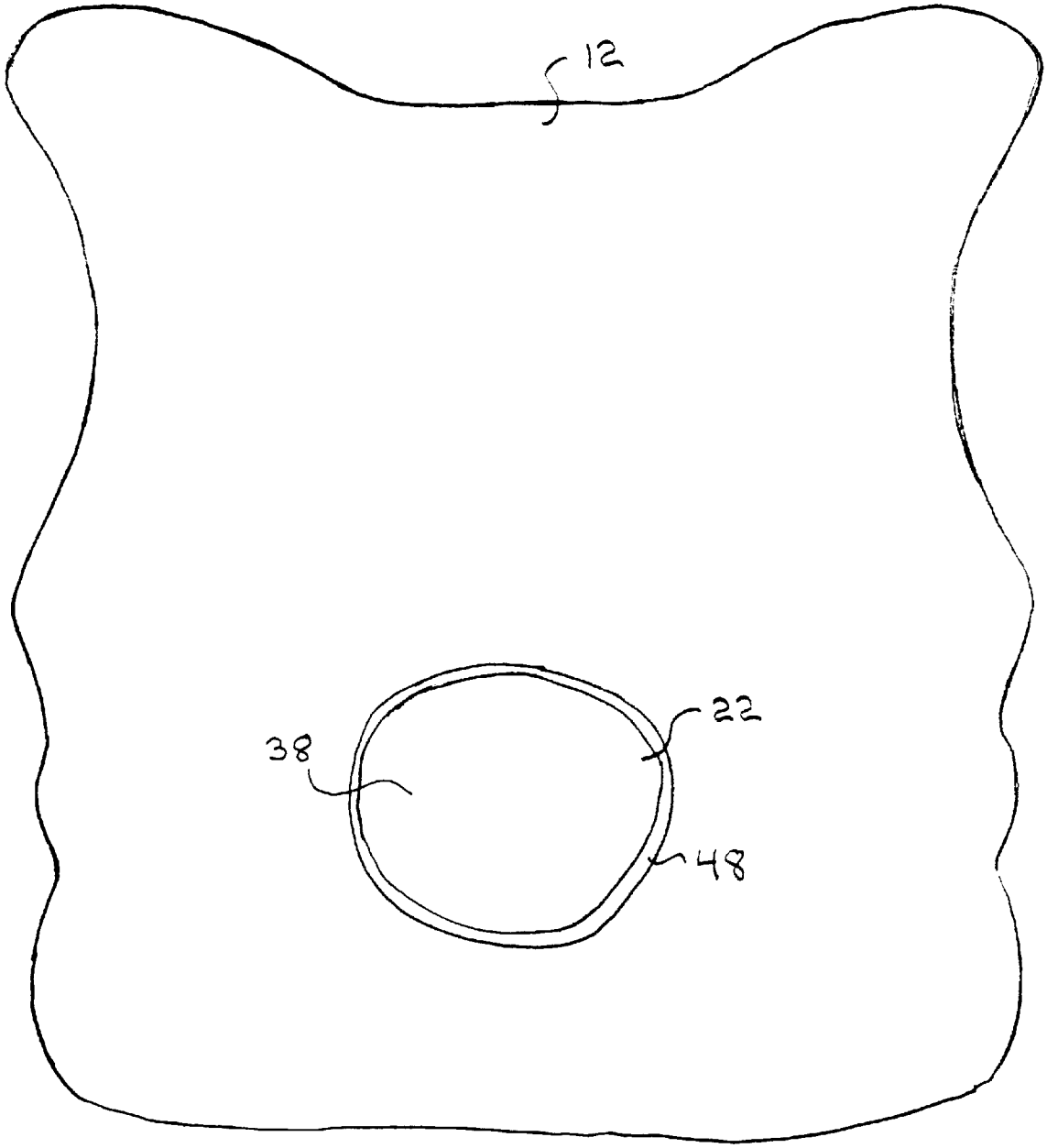
FIG. 5 is a top view of a prior art pillow.

FIG. 5 illustrates a prior art pillow 12. The pillow has a top valley 22 with a fabric membrane 38. This design suffices when the infant is face-up or rolls over face down in approximately the same orientation, so that the face rests in the top valley 22. Unfortunately, the infant may slide their body slightly downward so that the face is pressed against the cushioned part of the pillow 12, which tends to restrict the infant's breathing. The infant can be susceptible to suffocation in these circumstances.

The top valley 22 and the top valley extension 30 with the porous membrane 38 create an area that the infant can breathe through, when the face is in close proximity to or pressed against the membrane 38 in the top valley 22 or first top valley extension 30. The infant can breathe through the porous membrane 38, whenever the infant's face happens to press against the breathable membrane 38. Normally the infant is placed face up on the pillow 12, with the back of the head resting in the top valley 22. While unattended, the infant may rollover and have their face slip away from the breathable membrane 38 of the top valley 22. In this situation, the first top valley extension 30 provides an additional breathable area where the infant is likely to press their nose and mouth.

Without the first top valley extension 30 the infant may suffocate by pressing their face against the thick cushioned non-breathable portion of the pillow 12. Safety for the infant is increased with the first top valley extension 30. The parents can be more assured of the health and well being of their infant. The second top valley extension 56 and the third top valley extension 58 provide even more safety and security for the infant. If the infant rolls over and crawls further on to the pillow 12, away from the first top valley extension 30, then the second top valley extension 56 and the third top valley extension 58 create two additional indentations with a breathable membrane 38 that allow the infant to breath while face-down on the pillow 12.

Although the present invention has been described in considerable detail with regard to the preferred versions thereof, other versions are possible. Therefore, the appended claims should not be limited to the descriptions of the preferred versions contained herein.

What is claimed is:

1. A pillow with a breathable valley for an infant comprising:

a) a pillow having a top surface, a bottom surface, and a center portion, wherein the top surface has a smoothly transitioning concave surface forming a top valley about the center portion of the top surface, wherein the top valley has an upper perimeter with a first closed side and a first open side, wherein a first top valley extension projects from the first open side, wherein the top valley and the first top valley extension have an upper base; and wherein the bottom surface has a smoothly transitioning concave surface forming a bottom valley about the center portion of the bottom surface, wherein the bottom valley has a lower perimeter with a second closed side and a second open side, wherein a bottom valley extension projects from the second open side, wherein the bottom valley and the bottom valley extension have a lower base; and b) a membrane attached to the pillow, wherein the membrane separates the upper base of the top valley and first top valley extension from the lower base of the bottom valley and bottom valley extension.

2. The pillow with a breathable valley of claim 1, wherein the membrane is a semi-porous breathable membrane.

3. The pillow with a breathable valley of claim 2, wherein the top valley forms a substantially circular shape and the first top valley extension forms a substantially rectangular shape.

4. The pillow with a breathable valley of claim 3 further having a stiffener, wherein the stiffener is attached to the pillow and the membrane, whereby the stiffener holds the membrane taut, such that the infant's head can be supported, and whereby the stiffener reinforces the attachment between the pillow and the membrane.

5. The pillow with a breathable valley of claim 4, wherein the stiffener is a beading line, wherein the stiffener has a height 'h', wherein 'h' is between about 1/16 inch and about 5/16 inch.

6. The pillow with a breathable valley of claim 5, wherein the pillow has an outer covering, wherein a portion of the outer covering forms the membrane.

7. The pillow with a breathable valley of claim 6, wherein the outer covering having an exterior layer and an interior layer, wherein a portion of the interior layer is contained within the upper base of the top valley and first top valley extension.

8. The pillow with a breathable valley of claim 7, wherein the first top valley extension having a length 'L', wherein 'L' is between about 1 inch and about 4 inches.

9. The pillow with a breathable valley of claim 8, wherein 'L' is about 2 inches.

10. The pillow with a breathable valley of claim 9, wherein the combination of the top valley and the first top valley extension form a key-hole shape.

11. The pillow with a breathable valley of claim 10, wherein the membrane is thin having a thickness 't', wherein 't' is between about 1/64 inch and about 5/16 of an inch.

12. A pillow with a breathable valley for an infant comprising:

a) a pillow having a top valley, a first top valley extension, a second top valley extension, a third top valley extension, a top surface, a bottom surface, and a center portion, wherein the top surface has a smoothly transitioning concave surface forming the top valley about the center portion of the top surface, wherein the top valley has an upper perimeter with a first closed side and a first open side, wherein the first top valley extension projects from the first open side, wherein the second top valley extension and the third top valley extension extend radially from the top valley at about the upper perimeter, wherein the top valley, the first top valley extension, the second top valley extension and the third top valley extension have an upper base; and wherein the bottom surface has a smoothly transitioning concave surface forming a bottom valley about the center portion of the bottom surface, wherein the bottom valley has a lower perimeter with a second closed side and a second open side, wherein a bottom valley extension projects from the second open side, wherein the bottom valley and the bottom valley extension have a lower base; and b) a membrane attached to the pillow, wherein the membrane separates the upper base of the top valley and first top valley extension from the lower base of the bottom valley and bottom valley extension.

13. The pillow with a breathable valley of claim 12 further comprising a second bottom valley extension and a third bottom valley extension, wherein the membrane separates the upper base of the second top valley extension and the third top valley extension from the lower base of the second bottom valley extension and third bottom valley extension.

14. The pillow with a breathable valley of claim 13, wherein the membrane is a semi-porous breathable membrane.

15. The pillow with a breathable valley of claim 14 further having a stiffener, wherein the stiffener is attached to the pillow and the membrane, whereby the stiffener holds the membrane taut, such that the infant's head can be supported, and whereby the stiffener reinforces the attachment between the pillow and the membrane.

16. The pillow with a breathable valley of claim 15, wherein the stiffener is a beading line, wherein the stiffener has a height 'h', wherein 'h' is between about 1/16 inch and about 5/16 inch.

17. The pillow with a breathable valley of claim 16, wherein the pillow has an outer covering, wherein a portion of the outer covering forms the membrane.

* * * * *